United States Patent [19]

Rix

[11] 4,327,485

[45] May 4, 1982

[54] PISTOL GRIP TOOL

[75] Inventor: Robert D. Rix, Winston-Salem, N.C.

[73] Assignee: AMP Incorporated, Harrisburg, Pa.

[21] Appl. No.: 152,070

[22] Filed: May 21, 1980

[51] Int. Cl.[3] ..... H01R 43/04

[52] U.S. Cl. ..... 29/751; 29/758; 81/357; 81/365; 173/115; 227/142

[58] Field of Search ..... 29/751, 267, 750, 268, 29/758, 752, 566.4, 861, 866; 173/115; 72/409, 410; 227/142; 81/355, 356, 357, 365, 385, 128, 301; 7/107

[56] References Cited

U.S. PATENT DOCUMENTS

| | | | |
|---|---|---|---|
| 1,855,025 | 4/1932 | Kott | 173/115 X |
| 2,285,384 | 6/1942 | Schott | 227/142 X |
| 2,787,179 | 4/1957 | Warner | 173/115 |
| 3,742,571 | 7/1973 | Brehm | 29/751 X |
| 3,890,858 | 6/1975 | Lawson et al. | 81/9.5 R |
| 4,205,435 | 6/1980 | Holt | 29/758 X |
| 4,286,381 | 9/1981 | Litehizer, Jr. | 29/751 |

*Primary Examiner*—Carl E. Hall
*Attorney, Agent, or Firm*—Gerald K. Kita

[57] ABSTRACT

A tool is disclosed which has a variable tool stroke useful for inserting a wire conductor into and along a conductor terminating slot of an electrical terminal of the type disclosed in U.S. Pat. No. 4,141,618.

5 Claims, 5 Drawing Figures

PISTOL GRIP TOOL

FIELD OF THE INVENTION

The invention relates to a hand operated, pistol grip tool which has a variable tool stroke useful for making an electrical connection by inserting a wire conductor into and along a conductor terminating slot or open seam of an electrical terminal.

BACKGROUND OF THE ART

An electrical terminal is disclosed in U.S. Pat. No. 4,141,618 in the form of a single blank of metal rolled into a barrel shape and having a longitudinal open seam defining a conductor receiving slot. One or more insulation covered wire conductors are forcibly inserted into and along the slot. The sides of the slot define jaws which are urged by the barrel resiliency to penetrate the conductor insulation and grip opposite sides of the conductors. A transverse slot, i.e. a slot projecting transversely of the conductor receiving slot, divides the terminal into tandem pairs of jaws.

SUMMARY OF THE INVENTION

A hand operated, pistol grip tool is useful for holding an insulation covered wire conductor, and for forcefully inserting the same into and along the terminal wire receiving slot. The extent of the tool stroke determines the depth to which the conductor is inserted along the slot. A manually pivotable trigger of the tool is operated to adjust the extent of the tool stroke.

OBJECTS

An object of the present invention is to provide a hand operated, pistol grip tool with a tool stroke which can be adjusted.

Another object is to provide a hand operated, pistol grip tool, which inserts a conductor along a conductor receiving slot of an electrical terminal, the tool having a manually pivotable trigger which adjusts the extent of the tool stroke to place the conductor selectively along the slot.

Other objects and advantages of the present invention will become apparent from the following detailed description taken in conjunction with the drawings.

DESCRIPTION OF THE DRAWINGS

FIG. 5 is a side elevation in section of the tool shown in FIG. 1.

DETAILED DESCRIPTION

Figure 1:
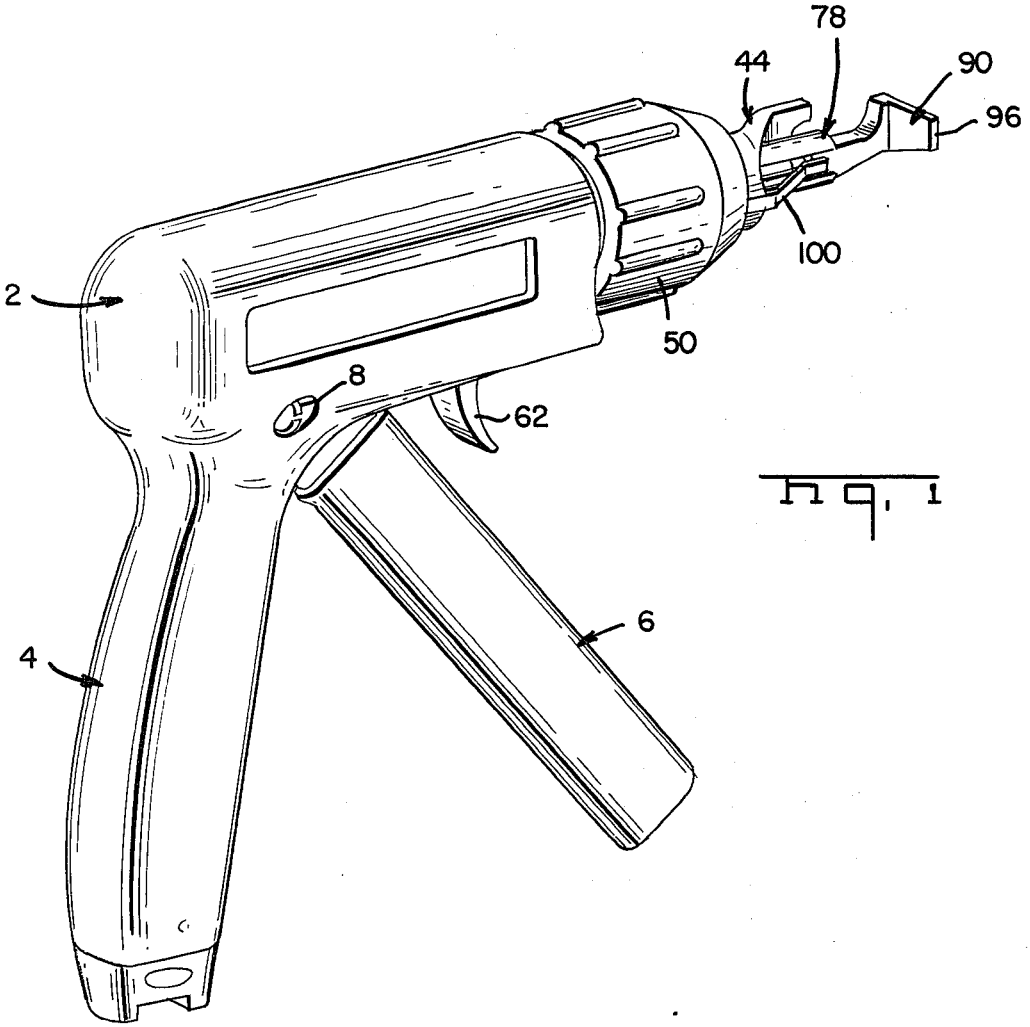
FIG. 1 is a perspective of a preferred embodiment of a pistol grip tool according to the present invention.

FIGS. 1–5 show a tool generally at 1 with a molded plastic casing portion 2 having an integral pistol type grip or handle 4 and a trigger or lever 6 pivotally secured to the casing portion 2 by a roll pin 8. The lever 6 projects into the interior of the casing portion 6 through a clearance opening 10 which allows the lever to pivot toward the grip 4 without interference. One end of the lever has an arcuate cam surface 12 for a purpose to be described.

The tool also includes a plastic casing portion 14 which is partially inserted in the interior of casing portion 2. The top wall 16 of the casing portion 14 is arcuate and impinges against a conforming arcuate wall 18 of the casing portion 2. The roll pin 8 passes through a portion 20 of the casing portion 14 and secures together the casing portions 2 and 14.

The casing portion 14 is provided with an elongated cylindrical, stepped diameter bore 22 in which is slidably received an elongated, stepped diameter ram 24. A coil spring 26 encircles a portion of the ram. One end of the spring is stopped against an enlarged diameter plate 28 on an end of the ram 24. The plate also serves as a bearing plate which is engaged by the cam surface 12, as the lever 6 is pivoted toward the handle or grip 4, to displace the ram 24 and compress the coil spring, in the performance of a tool stroke. The other end of the coil spring is stopped against a generally annular bearing block 30 in registration against a shoulder 32 of the stepped bore 22. The ram 24 passes through the block 30 and is provided with a stop shoulder 34.

When the lever 6 is released, the coil spring tends to lengthen or expand resiliently, displacing the ram toward the cam surface 12, in a return stroke. Such displacement is limited by seating a shoulder 38 of a ram portion 36 against a stop washer 40, which encircles the ram, and which mounts against a shoulder 42 of the stepped bore 22. The ram portion 36 is slidably mounted in a metal sleeve 44 having an external, enlarged collar 46 seated against an end 48 of the casing portion 14. A molded plastic nut 50 is threadably secured on the threaded portion 52 of the end 48. The ram portion 36, has a pin 54 which is slidably received along a slot 56 in the sleeve 44, as the ram is slidably displaced relative to the sleeve 44. The end 58 of the slot provides a stop for the pin 54, limiting the tool stroke.

To adjust the tool stroke, the tool 1 is provided with a second trigger lever 62 conveniently near the trigger lever 6. The lever 62 is pivotal about a pin 64 spanning across the interior 66 of a clevis-like member 68, which is inset in a recess 70 in the casing portion 14. The pin 64 also mounts the clevis to the casing portion 14. A return spring 72 is coiled over the pin 64 and has free ends 74 bearing, respectively, against the trigger 62 and the bearing block 30. An operator of the tool, wishing to adjust or shorten the tool stroke, uses one finger of the hand which grips the handle 4, pivoting the trigger lever 62 to the position shown in 62A. An opposite end 76 of the trigger lever 62 will be pivoted into and along the tool stroke path of the ram 24, toward a position shown at 76A. While holding the trigger lever 74 with one finger, the operator pivots the lever 6 toward the grip 4, causing a tool stroke as described. The extent of the tool stroke will be limited by the ram shoulder 34 engaging the lever end 76. Therefore, the tool stroke becomes shortened, and the pin 54 will be prevented from reaching the slot end 58. When the trigger levers 6 and 62 are released, the return springs will return the levers to their original positions as shown in FIG. 5.

Figure 2:
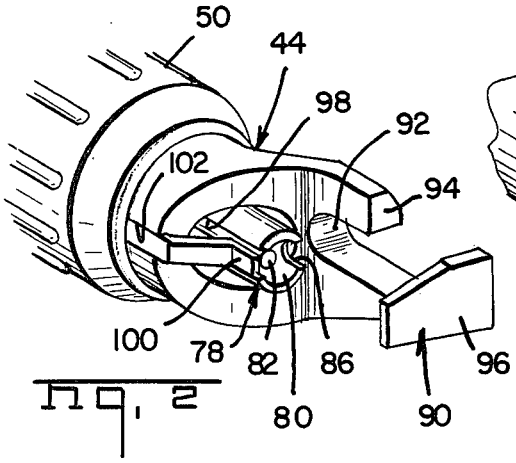
FIG. 2 is a fragmentary enlarged perspective of a tool head portion of the tool shown in FIG. 1.
Figure 3:
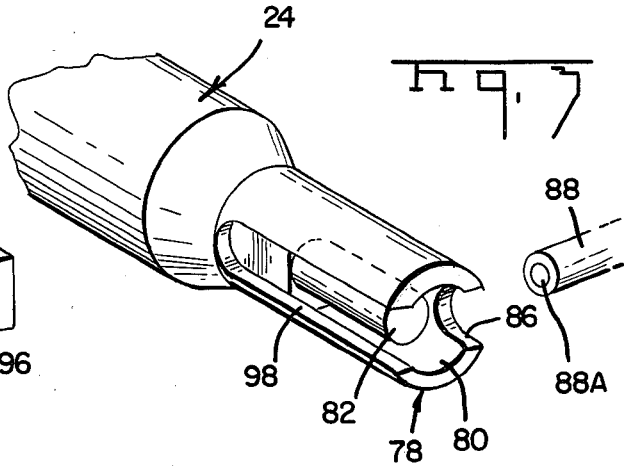
FIG. 3 is a fragmentary enlarged perspective of a portion of the tool head shown in FIG. 2.

FIGS. 2, 3, 4, and 5 illustrate the ram 24 having a toolhead end portion 78 the end of which is provided with a recess 80 in which is mounted a conductor engaging plug 82 secured in the recess 80 by a pin 84. The end of the toolhead portion also is provided with a shallow, arcuate notch 86. FIG. 3 shows an insulation covered wire conductor 88 to be received in the notch 86 against the plug 82. FIG. 2 shows the sleeve 44 provided with an integral, L-shaped anvil 90 with one leg thereof bifurcated by a guide slot 92 for the conductor, which is in parallel alignment with the notch 86. A notch opening 94 communicates with the slot 92 to allow laying the conductor 88 into the slot without having to poke the conductor endwise. The other leg 96 of the anvil is spaced from the ram end 78 and in direct alignment therewith. The end 78 is provided with a slot 98 across the diameter of the end 78 from the notch 86.

Figure 4:
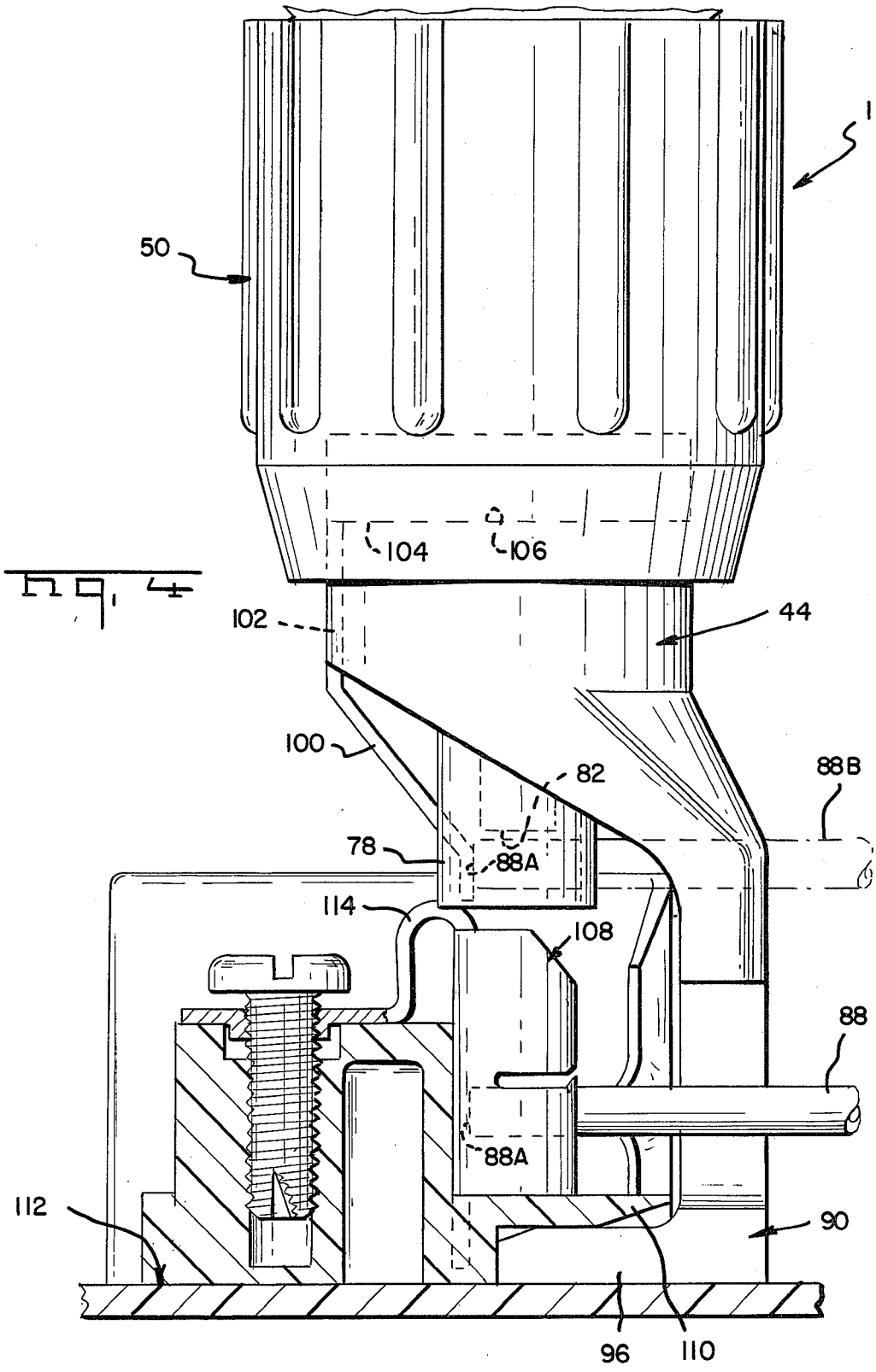
FIG. 4 is an enlarged elevation illustrating the tool head portion of the tool inserting an insulated conductor along a conductor receiving slot of a barrel shaped terminal.
Figure 7:
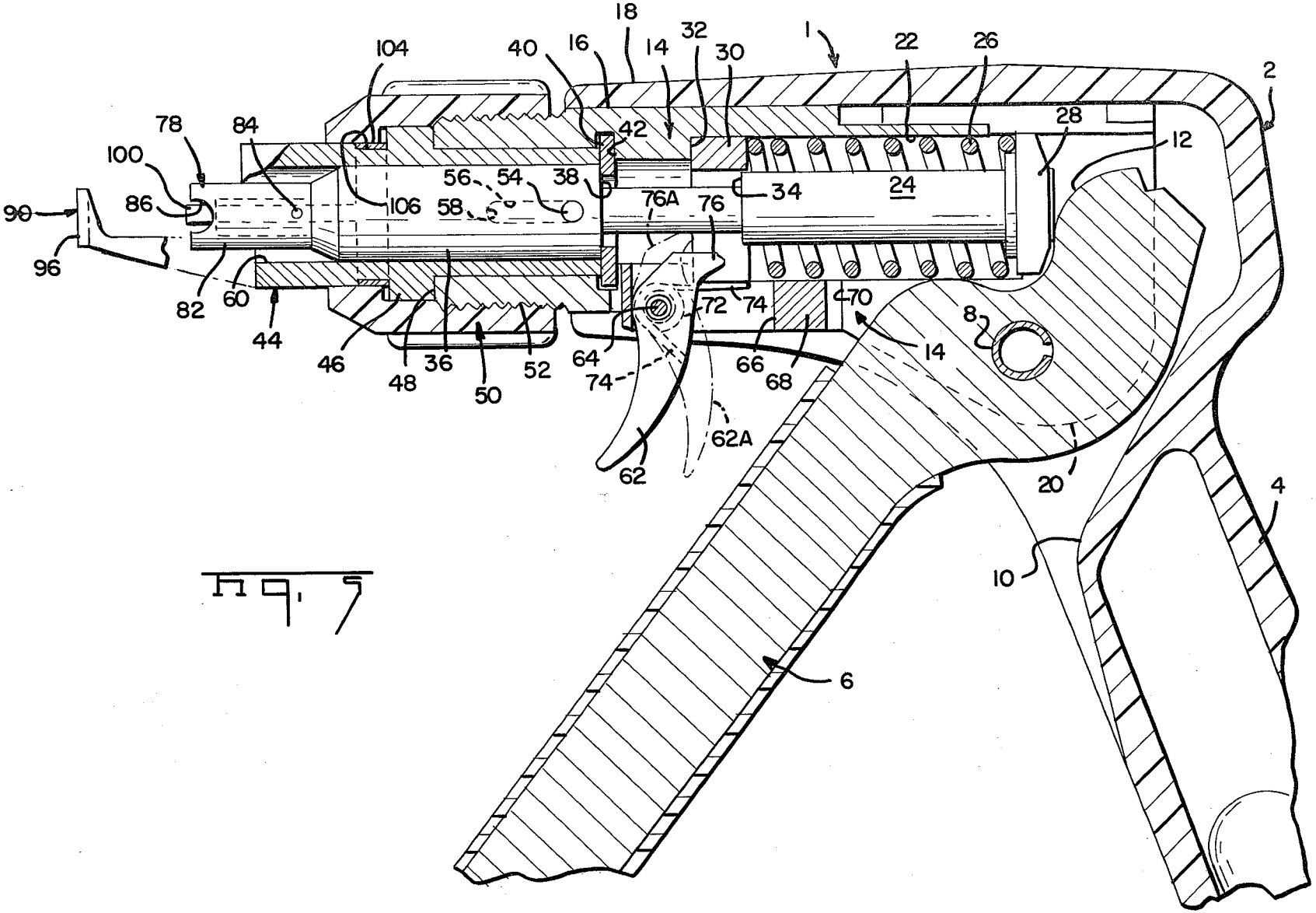

A metal resiliently deflectable finger 100, providing a wire stop for the end 88A of the conductor 88, is aligned along the slot 98. The finger 100 is bent to follow generally along the periphery of the end of sleeve 44, and lies along a groove 102 in the circumference of the sleeve 44. FIGS. 4 and 5 show the finger 100 integral with a band portion 104 inset in a circumferential groove 106 in the sleeve 44. The nut 50 overlies the band portion. FIG. 4 shows the tool 1 in operation. A barrel shaped terminal 108 is mounted on a molded plastic platform 110 of a barrier block 112, as disclosed in U.S. patent application, Ser. No. 20,774, filed 3-15-79. The tool of the present invention inserts a conductor 88 into a conductor receiving open seam of the terminal 108 to establish an electrical connection. More particularly, an operator positions the conductor 88 in the toolhead 78 in a manner previously described. The operator then positions the tool so that the terminal 108 is between the toolhead 78 and the anvil portion 96. The anvil portion 96 may seat against the insulation platform 110, or alternatively, against the terminal itself. A full tool stroke is produced in the manner previously described, so that the toolhead portion is advanced to encircle the end of the terminal 108. The annular end of the terminal enters the annular clearance between the plug 82 and the encircling remainder of the toolhead 78. The slot 98 advantageously provides a clearance receiving the bight 114 of the terminal. The plug 82 also advances, transferring the conductor 88 from the toolhead slot 86 into and along the terminal seam to its position shown in FIG. 4. The wire stop finger 100 will enter the open end of the terminal, guiding the conductor during its insertion. The resiliency of the finger will prevent its impinging to a halt against the terminal. A shorter tool stroke is utilized to insert another conductor 88B, similar to conductor 88, part way along the terminal seam. Thus, as shown in FIG. 4, the conductor 88B is located in the toolhead 78, in manner similar in respect to the previously described conductor 88. The tool stroke is adjusted by use of the trigger lever 62, so that a shorter tool stroke inserts the conductor 88B to a limited extent along the terminal seam. Thereby, both conductors 88 and 88B are inserted at different locations along the terminal seam.

Although a preferred embodiment of the present invention is disclosed, other embodiments and modifications thereof which would be apparent to one having ordinary skill is intended to be covered by the spirit and scope of the appended claims.

What is claimed is:

1. In a tool provided with a ram mounted in a casing and a lever mounted to the casing pivotally to displace the ram outwardly of the casing to provide a force-applying, tool stroke, the improvement comprising:

a shoulder provided on said ram, and a trigger pivotally mounted on said casing and provided with a manually engageable portion and a stop portion projecting into the stroke path of said ram and being engaged by said shoulder to limit the extent of stroke, said trigger being pivotable to remove said stop portion from the stroke path of said ram.

2. The improvement as recited in claim 1, and further including: an L-shaped anvil mounted on said casing and provided with a conductor holding first slot in a first leg and a second leg spaced from the ram end and in alignment therewith.

3. The structure as recited in claim 2, and further including: a wire stop finger mounted on said casing and entering a second slot in said ram.

4. The structure as recited in claim 3, and further including: a pin on said ram slidably received in a third slot of said casing, the end of said slot providing a stop for said pin.

5. The structure as recited in claim 4, and further including: a recess in the end of said ram, a conductor engaging plug internally of said ram recess, and a conductor receiving notch in a side of said ram opposite said finger, said notch communicating with said ram recess.

* * * * *